US010926286B2

(12) United States Patent
Pidan et al.

(10) Patent No.: US 10,926,286 B2
(45) Date of Patent: Feb. 23, 2021

(54) DEVICE FOR APPLYING A VISCOUS MATERIAL

(71) Applicant: Broetje-Automation GmbH, Rastede (DE)

(72) Inventors: Sergej Pidan, Winnenden (DE); Kay Rupp, Stuttgart (DE); Christoph Schneider, Stuttgart (DE)

(73) Assignee: Broetje-Automation GmbH, Rastede (DE)

( * ) Notice: Subject to any disclaimer, the term of this patent is extended or adjusted under 35 U.S.C. 154(b) by 0 days.

(21) Appl. No.: 16/338,829

(22) PCT Filed: Jul. 19, 2017

(86) PCT No.: PCT/EP2017/068271
§ 371 (c)(1),
(2) Date: Apr. 2, 2019

(87) PCT Pub. No.: WO2018/059775
PCT Pub. Date: Apr. 5, 2018

(65) Prior Publication Data

US 2019/0232327 A1 Aug. 1, 2019

(30) Foreign Application Priority Data

Oct. 2, 2016 (DE) ..... 10 2016 118 694.5

(51) Int. Cl.
*B05C 5/02* (2006.01)
*B05C 11/10* (2006.01)
(Continued)

(52) U.S. Cl.
CPC ..... *B05C 5/0229* (2013.01); *B05C 5/0225* (2013.01); *B05C 11/1002* (2013.01);
(Continued)

(58) Field of Classification Search
CPC ..... B05C 5/0225; B05C 5/0229; B05C 9/02; B05C 11/1002; B05C 21/00; B05D 1/26;
(Continued)

(56) References Cited

U.S. PATENT DOCUMENTS 4,635,827 A * 1/1987 Roedig ..... B05C 7/00 222/160
4,858,172 A * 8/1989 Stern ..... G05D 7/0676 700/40

(Continued)

FOREIGN PATENT DOCUMENTS

DE 102009060475 7/2011
DE 102009060475 A1 * 7/2011 ..... B05C 3/109

(Continued)

OTHER PUBLICATIONS

"German Search Report," for Priority German Patent Application No. 102016118694.5 dated Apr. 27, 2017 (9 pages).

(Continued)

*Primary Examiner* — William P Fletcher, III
(74) *Attorney, Agent, or Firm* — Pauly, DeVries Smith & Deffner LLC

(57) ABSTRACT

An apparatus for applying a viscous material, comprising a bell having a circumferential mounting rim, and a feed line, wherein the material is conveyable via a conveying element through the feed line into the bell, wherein the bell can be transported with the mounting rim, in a direction of mounting, over a protruding element, in particular a rivet head, of a component, in order to encase the element with the material, wherein in the region of the bell or the feed line a metering member is provided, wherein in the course of an application process a flow of the material can be influenced by the metering member.

11 Claims, 3 Drawing Sheets

(51) Int. Cl.
*B05D 1/26* (2006.01)
*B05D 7/14* (2006.01)

(52) U.S. Cl.
CPC ..... *B05D 1/26* (2013.01); *B05D 7/14* (2013.01); *B05D 2202/25* (2013.01); *B05D 2202/35* (2013.01); *B05D 2203/30* (2013.01); *B05D 2518/10* (2013.01)

(58) Field of Classification Search
CPC .. B05D 7/14; B05D 2202/40; B29C 45/0001; B29C 45/0046; B29C 45/02; B29C 45/021; B29C 45/022; B29C 45/024; B29C 45/025; B29C 45/03; B29C 45/036
See application file for complete search history.

(56) References Cited

U.S. PATENT DOCUMENTS 4,971,745 A * 11/1990 Ferenc ..... B29C 45/14336 264/263
5,322,381 A * 6/1994 Argo, II ..... B65D 47/06 222/566
5,954,728 A * 9/1999 Heller ..... B05C 17/00516 606/92
8,562,888 B2 * 10/2013 Kelley ..... B05C 11/1002 249/98
9,333,527 B2 * 5/2016 Jurado Blazquez ..... B05C 17/00516
9,849,637 B2 * 12/2017 Pajel ..... B29C 45/14065
9,968,962 B2 * 5/2018 Weinmann ..... B05C 17/015
10,035,287 B2 * 7/2018 Song ..... B29C 45/14336
2008/0134971 A1 * 6/2008 Bradley ..... F26B 23/04 118/641

FOREIGN PATENT DOCUMENTS

| | | |
|---|---|---|
| EP | 2865509 | 4/2015 |
| EP | 3072600 | 9/2016 |
| JP | 2012200694 | 10/2012 |
| JP | S50145095 | 10/2012 |
| WO | 2018059775 | 4/2018 |

OTHER PUBLICATIONS

"International Search Report and Written Opinion," for PCT Application No. PCT/EP2017/068271 dated Oct. 9, 2017 (12 pages).
International Preliminary Report on Patentability for PCT Application No. PCT/EP2017/068271 dated Apr. 11, 2019 (8 pages). English Translation.

* cited by examiner

DEVICE FOR APPLYING A VISCOUS MATERIAL

CROSS-REFERENCE TO RELATED APPLICATIONS

This application is a national stage application under 35 U.S.C. 371 of International Patent Application Serial No. PCT/EP2017/068271, filed Jul. 19, 2017, which claims priority from German Patent Application No. DE 10 2016 118 694.5, filed Oct. 2, 2016, the disclosures of which are incorporated herein by reference.

FIELD OF THE TECHNOLOGY

The disclosure relates to an apparatus for applying a viscous material and to a method.

BACKGROUND

From the construction of aircraft structural parts, it is known to surround rivet heads of components separately with a viscous material or a sealing compound. To this end, a bell or bell nozzle is slipped over the rivet head and the sealing material is applied into the bell. This frequently results in undesirable behavior when a thread of the sealing compound is cut. Moreover, excess material disadvantageously accumulates on the outer rim of the bell nozzle.

SUMMARY

The object of the disclosure is to define an apparatus for applying a viscous material, which apparatus enables a reproducible application with low levels of soiling.

This object can be achieved, for an apparatus disclosed. Through the provision of the metering member, a more accurate feeding of the viscous material can be realized. The separation of the material from the element after completed application can also be favorably influenced.

By a bell is here generally understood an open cavity which, with an opening or the mounting rim to the fore, can be slipped over the protruding element in the direction of mounting. The shape of the bell is, largely optional, for example, hemispherical, cylindrical or similar.

By a metering member is understood, any means with which at least a part of the material flow to be used for the application can be influenced in addition to the conveying means. The immediate proximity of the metering member to the bell or to a discharge region of the material flow can here enable the material not only to be conveyed in the direction of application, but, where necessary, also partially retracted.

Various advantages of the disclosure can be used to particularly good effect if the component is a structural component of an aircraft. In some embodiments, with the component, one or more materials from the group aluminum alloy, composite fiber material and/or titanium are covered. The protruding element can be a rivet head, the head of a screw bolt or of some other fastening means.

The viscous material can be constituted, in particular, by a sealing material, in particular an aircraft sealing compound or a silicone-like sealing material.

The application of the viscous material can be realized by a movement of the component and/or by a movement of the apparatus in the direction of mounting. With a view to a flexible and an at least partially automated production, it has proved advantageous if the apparatus is configured as an end effector for a manipulator, such as, for instance, a portal machine and/or an industrial robot.

In some embodiments, the metering member is arranged on a branch of the feed line, in particular just before an entry of the feed line into the bell. This allows a simple structural realization, wherein the proximity of the metering member to the bell allows a rapid and direct influencing of the material flow in the region of the bell.

In some embodiments, the metering member can also be provided directly in the bell. For example, in such an embodiment a hollow cylinder can be provided as the metering member, which hollow cylinder is arranged concentrically around the feed line and can be advanced in the bell.

Generally advantageously, it is provided that the metering member comprises a movable metering piston, so that a simple and effective possibility of an advancement, or, indeed, a retraction, of the viscous material is achieved by a movement of the metering piston. In various embodiments, the metering piston is here movable in such a way that it can be driven by an actuator. In some embodiments, the driven movement is here realized in two directions, so that on the one hand a material advancement, and on the other hand a material retraction, is enabled.

In a further detailed embodiment, it can here be provided that the metering piston, in at least one position, terminates substantially flush with a wall of the feed line and/or of the bell. As a result, the material before the metering piston can be freely transported, so that no unmoved material quantity can accumulate before the metering piston.

Generally advantageously, after the bell has been lifted off the element, a retraction of the material is realized by the metering member. This allows an improved separation of a material thread and reduces undesirable material accumulation in the marginal region of the bell.

The object of the disclosure is further achieved by a method for applying a viscous material to a protruding element of a component by means of an apparatus according to the disclosure, comprising the steps of mounting of the bell onto the component; filling of the bell with the viscous material, so that the element is encased, wherein, at least in part, a material advancement is realized by the metering member; and removal of the bell from the element.

In some embodiments, the method further comprises the step:

retraction of the material by means of the metering member in the course of removal of the bell from the element in order to facilitate a separation of a material thread.

Further advantages and features emerge from the below-described illustrative embodiment.

Various embodiments provide an apparatus for applying a viscous material, comprising a bell having a circumferential mounting rim, and a feed line, wherein the material is conveyable via a conveying means through the feed line into the bell, wherein the bell can be transported with the mounting rim, in a direction of mounting, over a protruding element, in particular a rivet head, of a component, in order to encase the element with the material, wherein in the region of the bell or the feed line a metering member is provided, wherein, in the course of an application process, a flow of the material can be influenced by means of the metering member.

In some embodiments, the metering member is arranged on a branch of the feed line, in particular just before an entry of the feed line into the bell.

In some embodiments, the metering member comprises a movable metering piston.

In some embodiments, the metering piston is movable in such a way that it can be driven by an actuator, in particular in two directions.

In some embodiments, the metering piston, in at least one position, terminates substantially flush with a wall of the feed line and/or of the bell.

In some embodiments, after the bell has been lifted off the element, a retraction of the material is realized by the metering member.

Various embodiments provide a method for applying a viscous material to a protruding element of a component by means of an apparatus as disclosed herein, comprising: mounting of the bell onto the component; filling of the bell with the viscous material, so that the element is encased, wherein, at least in part, a material advancement is realized by the metering member; and removal of the bell from the element.

In various embodiments, the method can further include retraction of the material by means of the metering member in the course of removal of the bell from the element, in order to facilitate a separation of a material thread.

BRIEF DESCRIPTION OF THE DRAWINGS

Below, an illustrative embodiment is described and is explained in greater detail with reference to the accompanying drawings, wherein.

DETAILED DESCRIPTION

Figure 1:
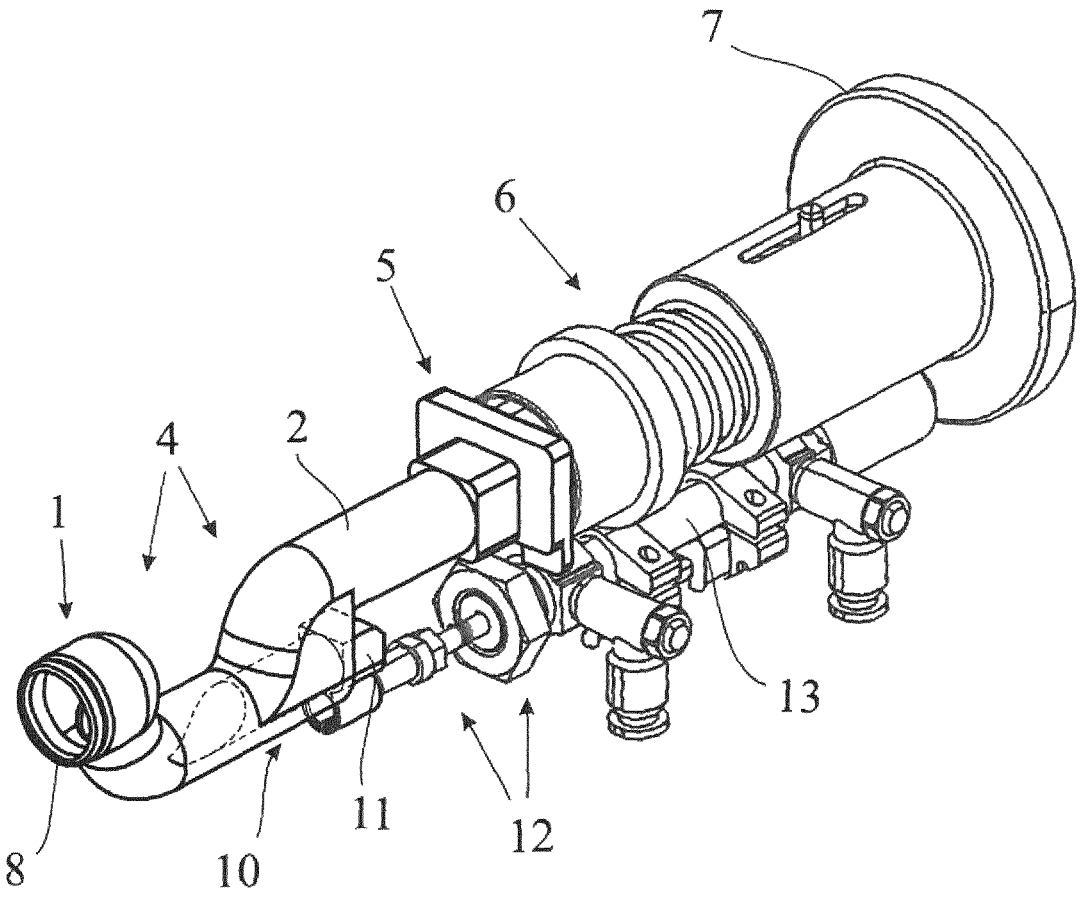
FIG. 1 shows a three-dimensional view of an apparatus according to various embodiments.
Figure 2:
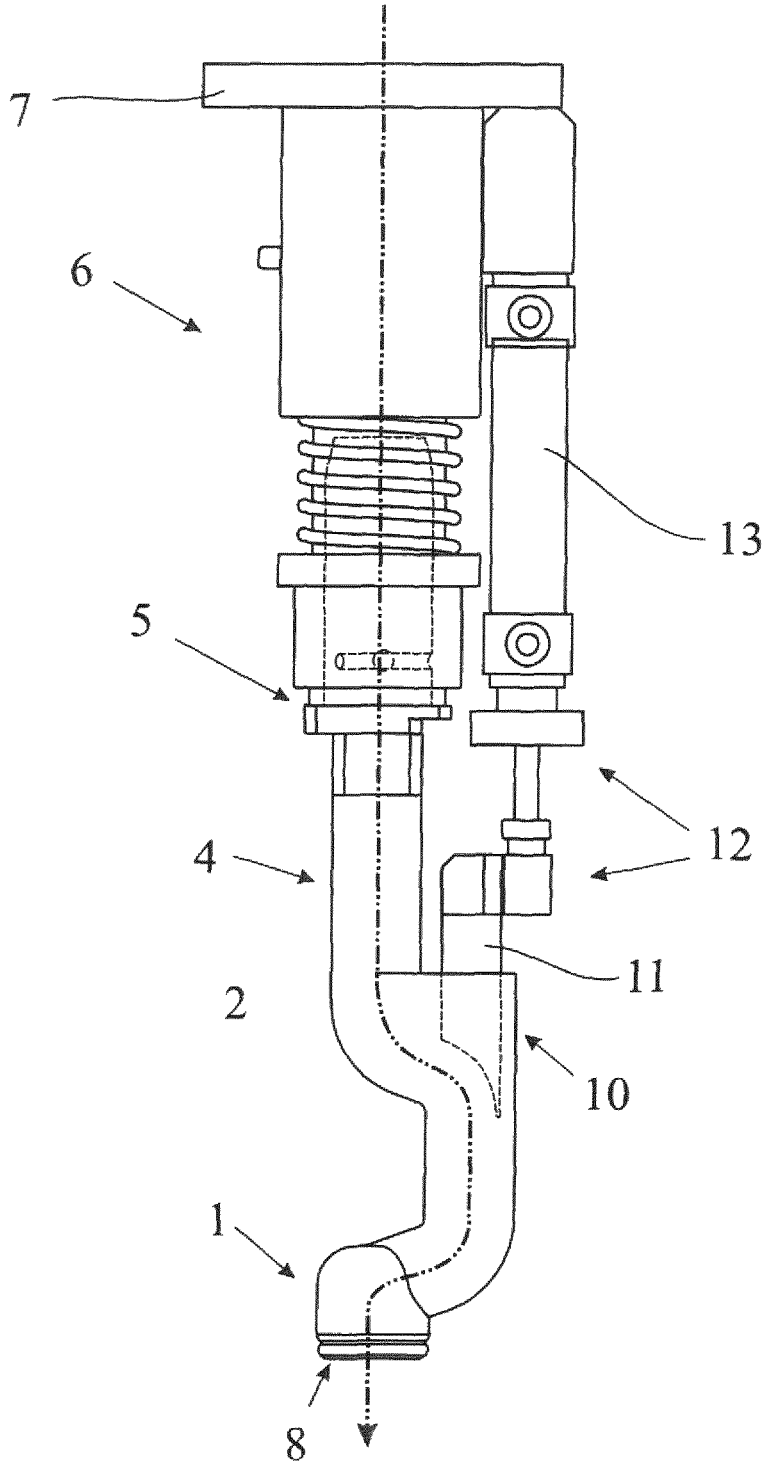
FIG. 2 shows a sectional view of the apparatus from FIG. 1, from the side.

FIG. 1 shows an apparatus for applying a viscous material in the form of a sealant to rivet heads of structural components of aircraft.

The apparatus is configured in its entirety on an end effector of a robot arm. A front end is formed by a bell 1, which can be loaded with the viscous material 3 via a feed line 2. A conveying means 9 (not represented) is provided on the end effector upstream of the feed line 2 and can convey the viscous material from a reservoir into the feed line.

In the present case, the bell 1 and the feed line 2 form a nozzle body 4 as the structural unit, wherein the nozzle body 4, as an exchangeable module, is connectable at an interface 5 to a compressible receptacle 6 for length compensation. On the opposite side of the receptacle 6 is found a flange 7 for connection to the further end effector.

The bell is movable with a mounting rim 8 over a protruding element 9 in the form of a rivet head of a component 9*a* in order to enable the application of the material 3.

Just before the feed line 2 joins the bell 1, a branch 10 of the feed line 2 is provided. In the branch 10, a metering piston 11 of a metering member 12 is sealingly guided. The metering piston 11 is advanceable and retractable by means of an, in the present case, pneumatic actuator 13 of the metering member 12.

A front end of the metering piston 11 is concave and beveled in shape, so that, in one position of the metering piston, it forms a flush inner wall with the rest of the feed line 2. This promotes a full exchange, in the course of the material conveyance, of the material 3 present before the metering piston 11.

Figure 3:
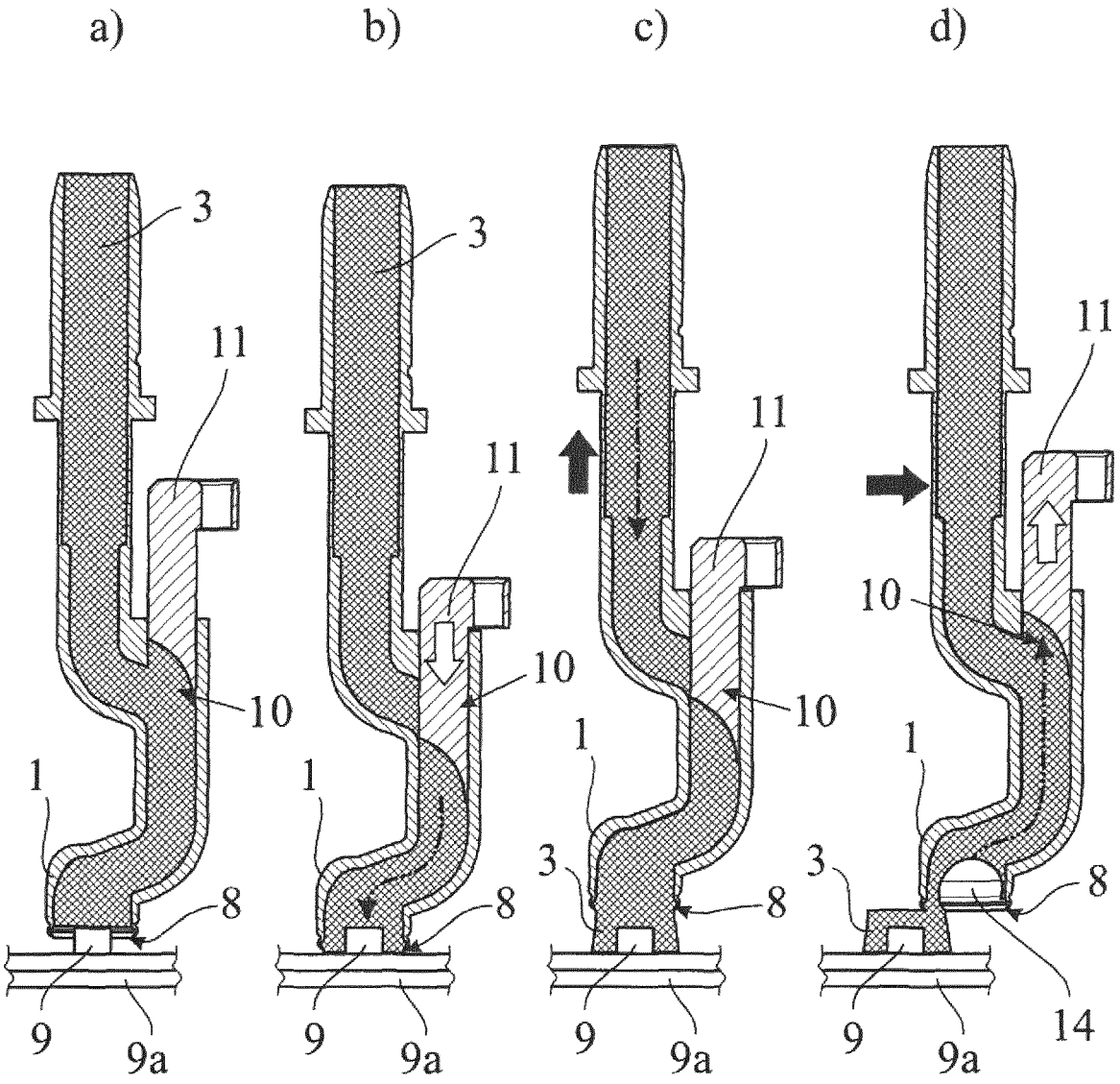
FIG. 3 shows a schematized sectional view of the apparatus from FIG. 1 in four consecutive steps a to d of an application process.

The functioning of various embodiments is explained in greater detail on the basis of the schematically represented sequences in FIG. 3:

Initially the metering piston 11 is in a retracted position and the bell 1 is partially filled with viscous material 3. The bell 1 is slipped over the rivet head 9 by means of the robot arm in a direction of mounting, until the mounting rim 8 rests on the component 9*a* (Diagram a in FIG. 3).

After this, the metering piston 11 is pushed by means of the actuator 12 forward in the direction of the bell 1, whereby the bell 1 is completely filled with material 3 and the rivet head 9 is completely encased with material 3 (Diagram b in FIG. 3).

Subsequently, the bell 1 is moved counter to the direction of mounting, by a defined distance, away from the rivet head 9, wherein initially still further material 3 is additionally introduced by the conveying means (Diagram c in FIG. 3).

Finally, the metering piston 11 is moved back again into the retracted position, while a lateral and/or circular movement of the bell 1 is realized in order to effect a separation of the material or of a material thread. Through this retraction of the metering piston 11, material is also withdrawn from the bell into the region of the feed line, as is indicated schematically by a resulting cavity 14 in the bell 1. This promotes, in total, a clean separation of the material thread and reduces soiling of an outer wall of the bell with excess material 3.

Finally, the apparatus is moved over the next rivet head and the above-described sequence is repeated.

The invention claimed is:

1. An apparatus for applying a viscous material, comprising:

a bell having a circumferential mounting rim; and a feed line, wherein the material is conveyable via a conveying means through the feed line into the bell, wherein the bell can be transported with the mounting rim, in a direction of mounting, over a protruding element of a component, in order to encase the element with the material, wherein a metering member is provided in, on, or adjacent to the bell or the feed line, wherein the metering member is configured to influence a flow of the material during an application process, and wherein the bell can be lifted away from the element and the metering member is configured to retract the material after the bell is lifted away from the element.

2. The apparatus as claimed in claim 1, wherein the metering member is arranged on a branch of the feed line.

3. The apparatus as claimed in claim 1, wherein the metering member comprises a movable metering piston.

4. The apparatus as claimed in claim 3, wherein the metering piston is movable in such a way that it can be driven by an actuator.

5. The apparatus as claimed in claim 3, wherein the metering piston, in at least one position, terminates substantially flush with a wall of the feed line and/or of the bell.

6. The apparatus as claimed in claim 3, wherein the metering piston is movable in such a way that it can be driven by an actuator in two directions.

7. The apparatus as claimed in claim 1, wherein, after the bell has been lifted off the element, a retraction of the material is realized by the metering member.

8. A method for applying a viscous material to a protruding element of a component by the apparatus as claimed in claim 1, comprising:

filling of the bell with the viscous material, so that the element is encased, wherein, at least in part, advancement of the viscous material is realized by the metering member; and removing the bell from the element.

9. The method as claimed in claim 8, further comprising:

retraction of the material by the metering member in the course of removal of the bell from the element, in order to facilitate a separation of a thread of the viscous material.

10. The apparatus of claim 1, wherein the protruding element of a component comprises a rivet head.

11. The apparatus as claimed in claim 1, wherein the metering member is arranged on a branch of the feed line just before an entry of the feed line into the bell.

* * * * *